US005134834A

United States Patent [19]

Hayduchok

[11] Patent Number: 5,134,834

[45] Date of Patent: Aug. 4, 1992

[54] CONTENT-ACTIVATION SYSTEM FOR AN AUTOMATED MAIL EXTRACTION APPARATUS

[75] Inventor: George L. Hayduchok, Mantua, N.J.

[73] Assignee: Opex Corporation, Moorestown, N.J.

[21] Appl. No.: 687,982

[22] Filed: Apr. 19, 1991

[51] Int. Cl.[5] ..... B65B 57/00; B65B 43/30

[52] U.S. Cl. ..... 53/492; 53/75; 53/381.6

[58] Field of Search ..... 53/492, 75, 77, 52, 53/381.5, 381.6, 381.3; 73/865.8

[56] References Cited

U.S. PATENT DOCUMENTS 4,353,197 10/1982 Stevens et al. ..... 53/381.6 X
4,376,363 3/1983 Russell ..... 53/381.6 X
4,649,694 3/1987 Haley ..... 53/381.6
4,863,037 9/1989 Stevens et al. ..... 53/381.5 X
4,934,892 6/1990 Smith et al. ..... 53/381.6 X

*Primary Examiner*—James F. Coan
*Attorney, Agent, or Firm*—Weiser & Stapler

[57] ABSTRACT

Envelopes in a bulk-mail processing system are inspected for emptiness, which indicates that all of the contents have been removed. The envelopes are spread apart at an extraction station, for manual or automatic removal of contents. The light transmissivity of the envelope and contents is measured when the envelope is unspread, and then when the envelope is spread. Based on at least the measured transmissivities of the envelope when spread and unspread, a threshold value of transmissivity consistent with the envelope being empty is calculated.

22 Claims, 2 Drawing Sheets

CONTENT-ACTIVATION SYSTEM FOR AN AUTOMATED MAIL EXTRACTION APPARATUS

FIELD OF THE INVENTION

The present invention generally relates to machines for opening large quantities of envelopes for the extraction of contents therefrom. In particular, the present invention relates to an apparatus and method of determining whether all of the contents of an envelope have been removed.

BACKGROUND OF THE INVENTION

Automated machines for opening large quantities of envelopes are known, such as those machines disclosed in U. S. Pat. Nos. 4,124,968; 4,353,197; and 4,863,037, issued to the assignee of the present application, all of which are incorporated herein by reference. Such machines may be broadly classified by two types, one type in which the envelope is severed along at least one edge and then spread open to allow manual removal of the contents, and a second type in which the envelope is opened and the contents thereof extracted automatically.

FIG. 1 shows a typical prior art apparatus 10 for facilitating the manual extraction of contents from a large quantity of envelopes. A quantity of envelopes 12 are retained in a bin 14. One at a time, the envelopes 12 are removed from bin 14 by suction cup 16, which alternately extends into engagement with the nearest envelope in the bin, and retracts back into sloping shelf 18, carrying the envelope with it. Each envelope is then indexed by conveyor belts 20 along shelf 18 toward the upper right in FIG. 1, passing through cutter 13, which slits the topmost edge of each envelope, thereby opening the envelope. The belts are stopped when the opened envelope reaches a position between suction cups 22, 23. The suction cups 22, 23 are first moved toward each other until they engage the sides (faces) of the envelope, and are then moved apart, thereby spreading the sides of the envelope open. An envelope with its sides spread open is shown at 25 in FIG. 1. This spreading open of the envelope is designed to facilitate the extraction of any contents which may be present in the envelope by an operator positioned alongside shelf 26. To this end, all that is necessary is for the operator to reach into the spread open envelope 25 to extract its contents.

One of the most crucial considerations for fast and efficient extraction of the contents from a large quantity of envelopes is ascertaining that envelopes passing through the system are in fact emptied of all their contents. Whether the contents of the envelope are extracted directly by an operator's hand or by other means, there will always be a possibility that some of the contents of the envelope, such as a check or an important document, will remain stuck to one side of the envelope even when the opposite faces of the envelope are spread apart. In some envelopes, the contents may have been inserted folded, and others not. In some envelopes, the contents may be bunched to one side, rather than neatly centered within the envelope. These and many other variations in content configuration can occur even when all of the envelopes being processed are supposed to have identical contents.

Obviously, the accidental discarding of checks must be avoided. Even the loss of documents, such as copies of invoices which accompany the checks, is clearly undesirable. For a recipient of a large quantity of checks, such as a utility or a credit card company, the resulting confusion and delay in document processing can be expensive. Simultaneously, it is desirable to extract checks from envelopes as quickly as possible, while avoiding such errors. When a company receives a large quantity of checks, a delay of even a few hours in depositing the checks may result in a significant loss of interest income.

Machines in common use for opening envelopes and facilitating the extraction of their contents are capable of operating at extremely high speeds. Even for those machines which operate to spread the sides of the envelope apart to allow manual extraction of the contents, typical operating speeds may reach up to 2,400 envelopes per hour, or one envelope every 1.5 seconds. This gives rise to the corresponding need to ensure complete extraction of all contents without significantly interfering with the speed of the operation.

Commonly-used techniques for verifying that envelopes have been completely emptied operate on the principle of the transmissivity of radiant energy, such as visible light, infrared light, or sound, through the envelope and any contents therein. These techniques extend to two types of system operation, candling and content-activation. In the apparatus shown in FIG. 1, photocell 30 and light source 32 together form a candling apparatus, while light sources 33 and 34 interact with photocells 35 and 36, respectively, to form a content-activation apparatus. The content-activation apparatus operates at the extraction station with suction cups 22 and 23, while the candling apparatus, is disposed downstream in the path of the envelopes to inspect the envelopes after the contents have been removed.

In general principle, an empty envelope will allow a certain threshold quantity of light to pass through to the photocell, while an envelope having documents remaining therein will allow a lesser quantity of light to pass through to the photocell. This lesser light transmissivity of an envelope still containing a document or documents is used to signal, through a control system, that the envelope then passing by the photocell still contains documents. In a candling procedure, the envelope is flagged for special handling, e.g., manual removal of whatever remains in the envelope. In a content-activation procedure, the envelope is retained at the extraction station, since it is not yet ready for discarding.

FIG. 2 is a simplified view of the content-activation system used in the apparatus of FIG. 1. Lamps 33 and 34 direct light, at 41 and 42 respectively, through different points of a spread-open envelope 25. Light passing through the envelope is then accepted by photocells 35 and 36. Photocells 35 and 36 are in turn operatively connected to a belt drive control circuit 38 which operates a motor 40 for causing motion of the envelopes passing along the shelf 18. Two sets of lamps and photocells are used to compensate for potential irregular positioning of contents within the envelopes which are being processed for extraction. Photocells 35 and 36 interact with belt drive control circuit 38 in such a way that, when a sufficient quantity of light passes from the lamps 33 and 34 through envelope 25 to the photocells 35 and 36, the belt drive control circuit will cause the motor 40 to index the envelope 25 toward the candling apparatus 30 and 32, while simultaneously removing another of the envelopes 12 from the stack and moving it to the extraction station. In the apparatus of FIG. 1, the candling apparatus then act as a second check for contents remaining in the envelope 24, before it is discarded. If the candling apparatus detects any remaining items in the envelope 24, the apparatus will indicate that not all of the contents have been extracted, and will generally discontinue further tranport of the envelope so that the remaining contents may be extracted.

Candling and content-activation techniques generally operate on a principle of a fixed threshold value of light transmissivity (indicating an empty envelope). When the intensity of the light passing through an envelope is above the threshold value, the envelope is deemed empty, and when this intensity is below the threshold value, the envelope is deemed to be not empty. As a result, the effectiveness of the apparatus is highly dependent on the exact value of the threshold in relation to the characteristics of the envelope being subjected to extraction. The prior art apparatus shown in FIGS. 1 and 2 therefore includes an external knob 37 operating a potentiometer 39 which controls the threshold value of light transmissivity to be detected by the belt drive control circuit 38. In practice, however, it has been found that such techniques can be further improved. For example, in the context of automated extraction machines, a crucial factor affecting the efficiency of the operation is the variation in transmissivity caused by the spreading apart of the side of the envelope, as with the envelope 25 in FIG. 1. Such spreading apart of the envelope causes a significant variation and distortion of the observed transmissivity of the envelope, which very often results in a misreading of whether the envelope has been emptied of all its contents. This problem is one of the primary sources of error in prior art content-activation systems. No matter how carefully a threshold value is selected for identifying an empty envelope, there will nevertheless tend to be some error because a spread-open envelope which is actually empty may be observed to transmit less light than an envelope still having contents therein.

SUMMARY OF THE INVENTION

It is therefore a principal object of the present invention to provide a more accurate system for determining whether all of the contents of an envelope have been extracted.

It is another object of the present invention to provide a more accurate system of determining whether the contents have been extracted from an envelope, without significantly intefering with the speed of the extraction operation.

It is another object of the present invention to provide a more accurate system of determining whether the contents have been extracted from an envelope, which may be incorporated in many existing types of mail processing equipment.

In accordance with the above-mentioned objects, the present invention is a method and apparatus of determining whether an envelope is empty, in an apparatus for facilitating the extraction of contents from the envelope including means for spreading apart an opened envelope and means for measuring the transmissivity of the opened envelope and contents, measuring the transmissivity of the envelope and contents when the envelope is unspread and after the envelope is spread, and calculating, based on at least the measured transmissivities of the envelope when spread and unspread, a threshold value of transmissivity consistent with the envelope being empty.

After the empty envelope constant is obtained, the series of envelopes are processed. For each envelope in the series, the transmissivity is observed in two states: when the envelope is unspread, and then when the envelope is spread, but with the contents remaining therein. These observed transmissivities are then combined with the empty envelope constant to calculate a target value of transmissivity which would be consistent with a fully emptied envelope. This target value is then used as the threshold transmissivity value for determining when the particular envelope being opened has been emptied of all contents.

BRIEF DESCRIPTION OF THE DRAWINGS

The following specification and drawings describe an embodiment of the invention which is presently preferred; it being understood, however, that the invention is not limited to the precise embodiment shown.

DETAILED DESCRIPTION OF THE INVENTION

Figure 1:
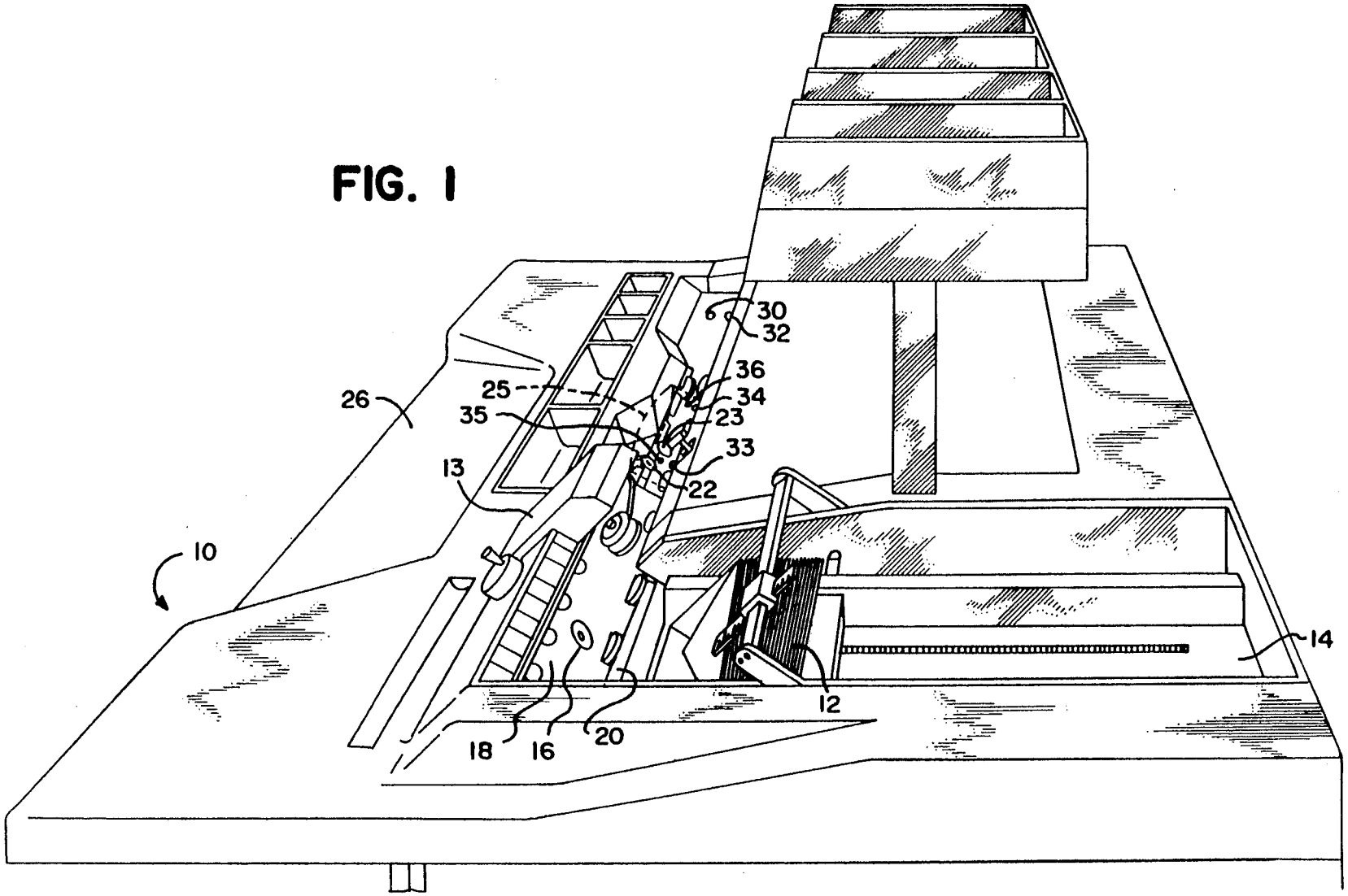
FIG. 1 is an isometric view of a typical prior art apparatus for embodying the system of the present invention.
Figure 2:
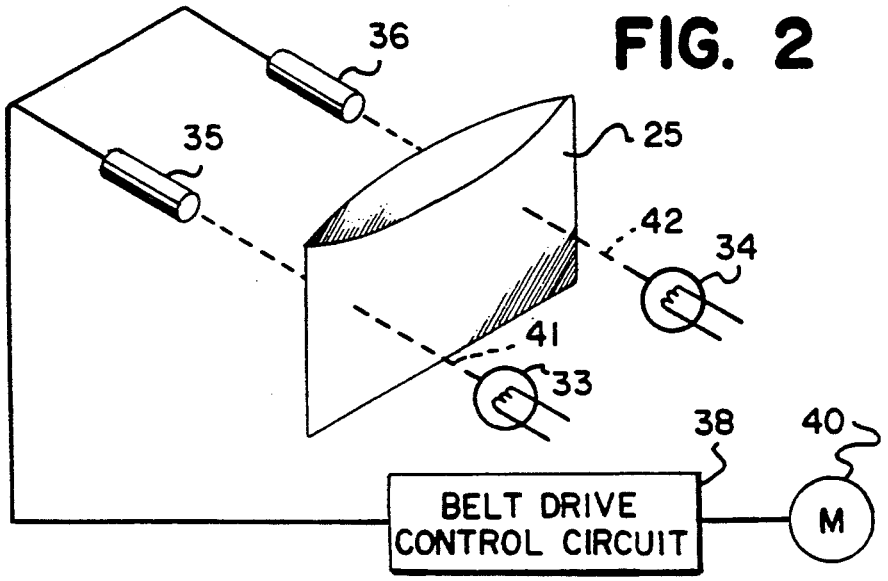
FIG. 2 is a simplified view of the content-activation system of the apparatus of FIG. 1.

The system of the present invention is used with apparatus (e.g., the apparatus shown in FIG. 1) including means for engaging the sides of an envelope 100 and spreading the sides of the envelope apart. Such means may include, by example and not by limitation, the suction cups 122, 123 shown in FIGS. 3(*a*)–3(*c*). The apparatus also includes candling means for observing (measuring) the transmissivity of the envelope 100 with or without its contents 101, and whether or not the sides of the envelope are spread apart. The candling means includes a light source 135 and a photocell 137, advantageously positioned adjacent to and preferably just ahead of the means for spreading the sides of the envelope apart, so that the transmissivity (to light in this preferred embodiment) of the envelope may be measured just before and just after the sides of the envelope are spread apart. Such an arrangement is shown, for example, by photocell 33 and light source 35 in the apparatus of FIG. 1, which are shown adjacent to the suction cups 22 and 23. However, such placement is merely illustrative, it being understood that the apparatus and method described herein is by no means limited to use in the apparatus shown in FIG. 1.

Figure 3A:
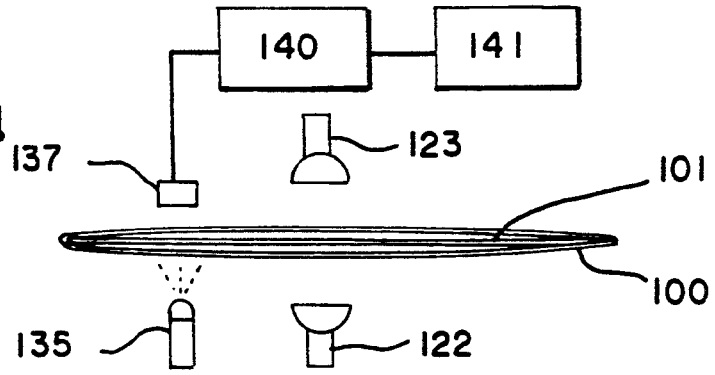
FIGS. 3(*a*)–(*c*) are a sequence of cross-sectional views through an envelope being spread open and having its contents extracted in accordance with the present invention.
Figure 3B:
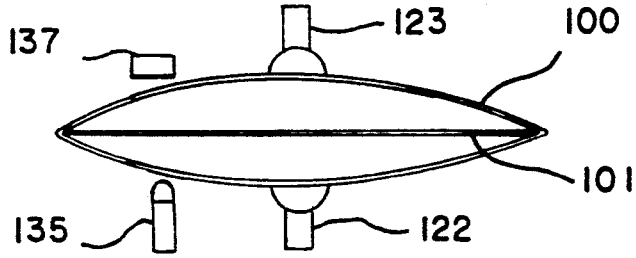
Figure 3C:
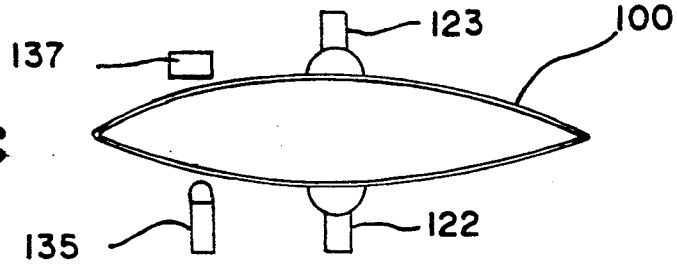

FIGS. 3(*a*)–(*c*) show a sequence of steps by which an envelope 100 having contents 101 therein is spread open by appropriate means such as suction cups 122, 123, while being measured for changes in transmissivity through means such as light source 135 and photocell 137. In the preferred embodiment described below, steps are taken to test a sample envelope which is intended to be representative of all of the envelopes in a given run, whereupon each subsequent envelope in the run (series) of envelopes is processed in turn. However, for purposes of simplicity in illustration, both the sample envelope and the envelopes being processed as part of the series will be shown as envelope 100 with contents 101. This is because in terms of their physical processing, the sample envelope and each subsequent envelope in the series are treated in virtually the same way. Differences in processing between the sample envelope and each subsequent envelope in the series will be made clear in the following description.

In many situations involving extraction of contents from a large quantity of envelopes, a given "run" of envelopes will involve one standardized type of envelope, containing a generally standardized set of documents. In the case of a utility or credit card company, for example, most incoming envelopes for bill payment purposes will include a standardized envelope provided for the customer by the company, and a similarly standardized invoice page returned to the company by the customer. In addition to the standardized invoice, there will usually be a check. Checks may come in a variety of colors and sizes, but the specific configuration of the check sent with the invoice will have little or no effect on the empty envelope when it is tested, except, of course, if the contents of the envelope have not been fully extracted.

The present invention is best utilized with a "run" of envelopes of generally similar characteristics. The most important such characteristic is the transmissive properties of the material of the envelopes, which is based on factors such as type of material, thickness, folding technique and color. Other factors, such as size and shape of the envelopes, are less important to the efficiency of the process.

In accordance with the present invention, at the beginning of extracting the contents from a run of generally standardized envelopes, a sample envelope is run through the apparatus and its transmissive properties measured. The purpose of running one sample envelope at the beginning is to permit the system of the present invention to "learn" the desired characteristics (i.e., transmissivity) associated with an empty envelope of the type in the run. This measured value, hereinafter referred to as the empty envelope constant (E), is obtained as follows.

The transmissivity of the sample envelope is first measured with its contents 101, before the sides of the envelope 100 are spread apart. The physical state of the apparatus at this reading is shown at FIG. 3(*a*). The measured value for the unspread envelope with its contents is defined as (X).

The sides of the sample envelope 100 are then spread apart by the suction cups 122, 123, as shown in FIG. 3(*b*), and a second measurement is made. The measured value for the spread envelope with its contents remaining is defined as (Y).

Thereafter, the contents 101 are removed from the sample envelope 100, as shown in FIG. 3(*c*), and a third measurement is made. The measured value for the spread envelope having no contents is defined as (Z).

The foregoing transmissivity measurements may be made by techniques which are themselves known in the art. For example, apparatus in current use typically includes means (shown generally as 140) operatively connected to the photocell 137 for discriminating gradations of light intensity (e.g., on a scale of 0 to 255). Such resolution has proven satisfactory in the art of bulk-mail processing equipment. With this type of apparatus, the transmissivity of the envelope at a given time is described as a number between 0 and 255. Arithmetical operations can then be performed on such measurements (e.g., in a processor 141) in a self consistent way. Thus, no matter what the actual (absolute) physical transmissivity of the envelope is, a consistent scale of measurement enables calculations based on the light transmissivity of the envelope as long as the intensity of the light source remains constant.

Following testing of the sample envelope, the observed readings (X), (Y), and (Z) are arithmetically combined to derive an empty envelope constant (E), which is consistent with the transmissivity of an empty, unspread envelope, according to the following equation:

$$E=|X-|Y-Z||\tag{1}$$

In this equation, the absolute value of the difference (Y)−(Z) represents the difference in transmissivity between the spread envelope with contents (Y) and the spread envelope without contents (Z). Thus, the difference (Y)−(Z) will represent the transmissivity of the contents only. When this value (Y)−(Z) is subtracted from the transmissivity of the unspread envelope with contents (X), the resulting difference (E) will represent the difference in transmissivity between the envelope including contents and the contents alone. Therefore, the value (E) is equal to the transmissivity of an empty, unspread envelope. This value (E), the empty envelope constant, is stored throughout the run of envelopes to be processed.

After the sample envelope is examined, the envelopes to be processed are run through the extraction point.

In running an envelope to be processed for extraction (as opposed to the sample envelope), a first measurement is taken before the envelope 100 is spread open when the contents are still in the envelope, as in FIG. 3(*a*). This measured transmissivity (of the unspread envelope with contents) is defined as (A). This measured value (A) (for each envelope) is used to obtain a deviation (D):

$$D=|A-E|\tag{2}$$

This deviation (D) represents the difference in transmissivity between the unspread envelope, with its contents, and the transmissivity of an unspread empty envelope. This difference is equal to the change in light transmissivity that will occur when the contents are extracted from the envelope and, by inference, equals the transmissivity of the contents being extracted.

In the course of the extraction process, the envelope 100 is then spread open (such as by suction cups 122, 123) and its transmissivity measured with the contents 101 remaining therein. This measured value (of the open envelope with contents) is defined as (B).

In determining when an envelope having its contents extracted is in fact empty, the operative variable is the difference between the transmissivity of the spread envelope with contents and the actual transmissivity of the contents being extracted. This difference will leave the transmissivity of the (remaining) empty, spread envelope. This target (threshold) value (associated with a spread open envelope after its contents have been removed) is defined as (C) and is calculated as follows:

$$C=|B-D|+K\tag{3}$$

In equation (3), the term (B)−(D) represents the difference in transmissivity between a spread open envelope still having contents therein, and the calculated transmissivity of the contents alone. (K) is an allowable error factor which is empirical and which depends on the characteristics of the envelopes, and of the particular extraction apparatus in use. This may include factors such as the uniformity (primarily in transmissivity) of the envelopes being processed and/or the brightness of the light source used or the presence of ambient light near the light source. Generally, the value for (K) will be relatively small (ideally zero) for envelopes which are highly uniform, or in situations where ambient light has been minimized. In other, less than ideal situations, such as where the transmissivity of the envelopes varies widely, or where the apparatus is subject to high levels of ambient light, the value of (K) will tend to be somewhat higher. In the preferred embodiment, wherein the resolution of the system is from 0 to 255, the value (K) can conceivably vary from 0 to 255. Although higher values of (K) will tend to compensate for wider variations in uniformity, there will be a corresponding increase in the potential for premature discard of an envelope prior to an effective extraction of its contents. Lower values of (K) will reduce this potential for error, but will compensate for fewer variations in uniformity.

The difference (C) represents a threshold value consistent with a spread, empty envelope, and thus constitutes the threshold value of transmissivity against which an envelope subject to extraction must be compared for determining when the envelope has been emptied. When the transmissivity of the envelope being processed is equal to or greater than (C), the envelope is deemed empty for purposes of activating the extraction apparatus to discard the empty envelope and to initiate processing of the next envelope. The value (C) is separately calculated for each envelope to be processed.

As is conventional, each envelope in a run is then tested (after the extraction of contents) to verify that all contents have been removed. This testing will preferably occur downstream from the extraction point, such as the candling position 24 in FIG. 1. In candling, the sides of an envelope are not usually spread apart. However, because the sides of the envelope had been spread in the extraction process, an envelope in the candling position may at times not be perfectly flat, as would an envelope before extraction. The improvements of the present invention could, if desired, be adapted to a candling procedure, to similarly account for distortion in transmissivity due to such spreading of the envelopes. However, this is generally not required to achieve an effective candling of the envelopes being processed.

In candling, those envelopes which are not found to be sufficiently light-transmissive to be empty, are "flagged" for special processing. Depending on the specific type of bulk-mail processing apparatus, this "flagging" may take many forms. For example, flagged envelopes may be mechanically out-sorted or re-routed to a particular location. Alternatively, as shown in FIG. 1, a flagged envelope may simply cause further transport of the envelopes to stop (i.e., further movement of envelopes along shelf 18). As used in the claims, the word "flagging" denotes any special treatment for certain envelopes in the course of processing.

Looking at the system of the present invention in a more general sense, the methodology of the present invention can be conceptually stated as follows. For a sample envelope, transmissivity is measured in three states in order to develop a constant which represents the transmissivity of an empty unspread envelope. For each envelope subsequently processed, the transmissivity of the unspread envelope with its contents is measured, and the transmissivity of the empty sample envelope is subtracted, obtaining a deviation which is equal to the transmissivity of the contents alone. When all of the contents are extracted from the envelope, the change in transmissivity will be substantially equal to this deviation. A threshold value for detecting an empty envelope is then calculated by subtracting this deviation from the measured transmissivity of the spread envelope with contents. As the contents are extracted from the envelope, the observed transmissivity will increase by the deviation and approach the threshold value. When the observed transmissivity of the envelope is greater than this threshold value, the envelope is deemed empty and can be discarded.

While somewhat more involved than the use of a simple constant threshold for determining the emptiness of an envelope, the simple arithmetic calculations required for processing each envelope do not consume a significant amount of time, and will in no way limit overall operating speed. However, fewer errors will result because certain variables which otherwise might effect individual envelopes in a run (such as the presence of more than an expected amount of contents) are taken into account with each separate calculation of the threshold value (C). More significantly, the methodology of the present invention reduces errors because it takes into account the change in "perceived transmissivity" of an envelope when its sides are spread apart, effectively eliminating such distortions in light transmissivity.

The improvements of the present invention are further capable of variation, if desired. For example, the value of the empty envelope constant (E) can be obtained directly, by measuring the transmissivity of an empty sample envelope of a type similar to the envelopes in the run, instead of deriving the transmissivity of the unspread, empty envelope by equation (1) above. Alternatively, the empty envelope constant (E) can be obtained by applying the above-described steps to a series of sample envelopes, and then averaging the calculated values for (E). It is even possible to continuously calculate the empty envelope constant (E) throughout a given run, calculating a new value of (E) for envelopes in the series based on the previously calculated value of (E). In other words, as each envelope is inspected, a new value of (E) is calculated for the envelope under inspection, adapting to ongoing system variations. To this end, a running average of values of (E) may be employed, if desired. In any event, an empty envelope constant, once obtained, may be stored and recalled from a previous run, or even pre-programmed in the data processor in cases where the apparatus is expected to repeatedly operate upon a particular type (or types) of envelope (e.g., in a bill-payment situation).

Yet another possible variation of the apparatus of the present invention is to include two (or more) coupled pairs of light sources and photocells at the extraction station. Detected transmissivity values may then be averaged before being employed in the above equations, or alternatively, could be processed independently so that each photocell would serve as a check on the other. Such an arrangement is useful in accounting for the presence of a folded check (or other document) inside the envelope, which is likely to cause the transmissivity of one portion of the envelope to differ from the transmissivity of another portion of the envelope.

Although the apparatus and method of the present invention are primarily directed toward determining an envelope's transmissivity to light, the techniques of the present invention may be employed in conjunction with other types of radiant energy. For example, acoustic transmitters may be utilized in lieu of a light source, with an acoustic receptor in place of the photocell. This might be desirable in situations in which the envelopes themselves are so opaque that removal of contents from them would not produce a sufficient variation in the intensity of light transmitted through each envelope from the light source to the photocell to permit the system to react. Radio frequency energy could be used in place of either light or sound waves. Other types of radiation, such as x-rays, are also potentially usable, particularly if the contents of the envelopes to be processed have characteristics which significantly impede the propagation of other types of radiation. Moreover, a combination of different types of radiant energy may be used, such as to afford latitude in the types of contents to be detected.

It will be understood that various changes in the details, materials and arrangement of parts which have been herein described and illustrated in order to explain the nature of this invention may be made by those skilled in the art within the principle and scope of the invention as expressed in the following claims.

I claim:

1. A method of determining whether an envelope is empty in an apparatus for facilitating the extraction of contents from envelopes, the apparatus including means for spreading apart an opened envelope and means for measuring the transmissivity of the opened envelope and the contents, comprising the steps of:

measuring the transmissivity of the envelope and contents when the envelope is unspread, calculating a deviation related to the difference between the measured transmissivity of the unspread envelope and a constant value related to the transmissivity of an unspread envelope having no contents therein, measuring the transmissivity of the envelope and contents after the envelope is spread, and calculating, based on at least the deviation and the measured transmissivity of the spread envelope, a threshold value of transmissivity consistent with the envelope being empty.

2. The method of claim 1, comprising the further steps of:

extracting contents from the envelope, measuring the transmissivity of the envelope after extraction, and comparing the measured transmissivity of the envelope to the threshold value.

3. The method of claim 2, wherein all the envelopes have substantially similar transmissive properties.

4. The method of claim 2, comprising the further step of flagging the envelope if the measured transmissivity of the envelope after extraction is less than the threshold value.

5. A method of determining whether an envelope is empty in an apparatus for facilitating the extraction of contents from a series of envelopes, the apparatus including means for spreading open the envelope and means for measuring the transmissivity of the opened envelope and contents, comprising the steps of:

(a) for a first envelope in the series of envelopes, (i) measuring the transmissivity of the first envelope and contents, (ii) measuring the transmissivity of the first envelope and contents after the sample envelope is spread apart, (iii) measuring the transmissivity of the spread first envelope after the contents are removed, and (iv) calculating a constant equivalent to the transmissivity of an unspread envelope with no contents, the constant being derived from the measured transmissivities of the unspread first envelope with contents, and the spread first envelope without contents; and (b) for a second, subsequent envelope in the series of (i) measuring the transmissivity of the second envelope and contents when the envelope is unspread, (ii) calculating a deviation related to the difference between the measured transmissivity of the unspread second envelope and contents and the calculated constant, (iii) measuring the transmissivity of the second envelope and contents after the second envelope is spread, and (iv) calculating, based on at least the deviation and the measured transmissivity of the spread second envelope, a threshold value of transmissivity consistent with the second envelope being empty.

6. The method of claim 5, wherein the envelopes in the series of envelopes have substantially similar transmissive characteristics.

7. The method of claim 5, further comprising the steps of:

for each envelope in the series of envelopes, calculating a value equivalent to the transmissivity of an unspread envelope with no contents, wherein the calculated value is derived from the measured transmissivity of the unspread envelope with contents, and the measured transmissivity of the spread envelope without contents, and calculating a deviation related to the difference between the measured transmissivity of the unspread envelope with contents and the calculated value.

8. The method of claim 5, further comprising the steps of:

for each envelope in the series of envelopes, calculating a value equivalent to the transmissivity of an unspread envelope with no contents, wherein the calculated value is derived from the measured transmissivity of the unspread envelope with contents, and the measured transmissivity of the spread envelope without contents, calculating an average value, based on the calculated values for at least two envelopes, and calculating a deviation related to the difference between the measured transmissivity of the unspread envelope with contents and the average value.

9. The method of claim 6, comprising the further steps of:

extracting contents from the envelope, measuring the transmissivity of the envelope after extraction, and comparing the measured transmissivity of the envelope to the threshold value.

10. The method of claim 9, comprising the further step of flagging the envelope if the measured transmissivity of the envelope after extraction is less than the threshold value.

11. An apparatus for facilitating the extraction of contents from envelopes, comprising:

means for spreading apart an opened envelope, means for measuring the transmissivity of the envelope when the envelope is unspread and when the envelope is spread, and control means for calculating, based on at least the measured transmissivity of the envelope when the envelope is spread and when the envelope is unspread, a threshold value of transmissivity consistent with the envelope being empty, wherein the control means includes means for storing a constant value related to the transmissivity of an unspread envelope having no contents therein, and means for calculating the constant related to the transmissivity of an unspread envelope with no contents, based on measured transmissivities of an unspread envelope with contents and a spread envelope without contents, and measured transmissivities of prior envelopes in the series when unspread with contents and when spread without contents.

12. The apparatus of claim 11, wherein the control means includes means for calculating a threshold value of transmissivity consistent with an envelope being empty, based on at least the measured transmissivity of the envelope when spread and when unspread, and the constant related to the transmissivity of an unspread envelope with no contents.

13. The apparatus of claim 12, wherein the constant related to the transmissivity of an unspread envelope with no contents is derived from the measured transmissivities of a sample envelope unspread and with contents and the sample envelope spread and without contents.

14. The apparatus of claim 11, further including means for comparing the measured transmissivity of the spread envelope to the threshold value.

15. The apparatus of claim 14, further comprising means for flagging an envelope if the measured transmissivity of the envelope is less than the threshold value.

16. An apparatus for facilitating the extraction of contents from envelopes, comprising:

means for spreading apart an opened envelope, means for measuring the transmissivity of the envelope when the envelope is unspread and when the envelope is spread, and control means for calculating, based on at least the measured transmissivity of the envelope when the envelope is spread and when the envelope is unspread, a threshold value of transmissivity consistent with the envelope being empty, wherein the control means includes means for storing a constant value related to the transmissivity of an unspread envelope having no contents therein, means for calculating the constant related to the transmissivity of an unspread envelope with no contents, based on measured transmissivities of an unspread envelope with contents and a spread envelope without contents, and means for averaging a plurality of calculated constants, based on the measured transmissivities of at least two envelopes measured unspread with contents and spread without contents.

17. The apparatus of claim 16, wherein the control means includes means for calculating a threshold value of transmissivity consistent with an envelope being empty, based on at least the measured transmissivity of the envelope when spread and when unspread, and the constant related to the transmissivity of an unspread envelope with no contents.

18. The apparatus of claim 17, wherein the constant related to the transmissivity of an unspread envelope with no contents is derived from the measured transmissivities of a sample envelope unspread and with contents and the sample envelope spread and without contents.

19. The apparatus of claim 16, further including means for comparing the measured transmissivity of the spread envelope to the threshold value.

20. The apparatus of claim 19, further comprising means for flagging an envelope if the measured transmissivity of the envelope is less than the threshold value.

21. An apparatus for facilitating the extraction of contents from a series of envelopes, comprising:

(a) means for spreading an envelope in the series;

(b) means for measuring the transmissivity of the envelope when the envelope is spread and when the envelope is unspread; and (c) control means, including:

(i) means for calculating a constant equivalent to the transmissivity of an unspread envelope with no contents, the constant being derived from the measured transmissivities of a spread sample envelope with contents and a spread sample envelope without contents, (ii) means for storing the constant, (iii) means for calculating a deviation related to the difference between the measured transmissivity of an envelope and contents and the constant, (iv) means for calculating, based on at least the deviation and the measured transmissivity of the spread envelope, a threshold value of transmissivity consistent with the envelope being empty, and (v) means for comparing the measured transmissivity of the envelope to the calculated threshold value.

22. The apparatus of claim 21, further including means for flagging the envelope if the measured transmissivity of the envelope after the extraction of contents is less than the threshold value.

* * * * *